US009631412B2

(12) United States Patent
Hellwig et al.

(10) Patent No.: US 9,631,412 B2
(45) Date of Patent: Apr. 25, 2017

(54) DOOR ACTUATOR

(71) Applicant: DORMA DEUTSCHLAND GMBH, Ennepetal (DE)

(72) Inventors: Alexander Hellwig, Ennepetal (DE); Sabine Wiemann, Ennepetal (DE); Thomas Salutzki, Witten (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/362,347

(22) PCT Filed: Nov. 14, 2012

(86) PCT No.: PCT/EP2012/004721

§ 371 (c)(1),
(2) Date: Jun. 2, 2014

(87) PCT Pub. No.: WO2013/079161

PCT Pub. Date: Jun. 6, 2013

(65) Prior Publication Data

US 2014/0290144 A1 Oct. 2, 2014

(30) Foreign Application Priority Data

Dec. 2, 2011 (DE) ..... 10 2011 055 977

(51) Int. Cl.
*E05F 3/10* (2006.01)
*E05F 3/22* (2006.01)

(52) U.S. Cl.
CPC ..... *E05F 3/10* (2013.01); *E05F 3/104* (2013.01); *E05F 3/22* (2013.01); *E05Y 2201/638* (2013.01); *E05Y 2201/706* (2013.01); *E05Y 2900/132* (2013.01); *Y10T 16/56* (2015.01)

(58) Field of Classification Search
CPC . E05F 3/104; E05F 3/10; E05F 1/1041; E05F 1/105; E05F 1/1066; E05F 1/12; E05F 1/1246; E05F 1/1253; E05F 1/1269
See application file for complete search history.

(56) References Cited

U.S. PATENT DOCUMENTS

| | | | | |
|---|---|---|---|---|
| 3,568,241 | A * | 3/1971 | Uffner | 16/321 |
| 3,932,913 | A * | 1/1976 | Johnson | 16/245 |
| 5,901,412 | A | 5/1999 | Jentsch | |
| 6,618,899 | B1 * | 9/2003 | Ginzel et al. | 16/62 |
| 7,007,341 | B2 * | 3/2006 | Wang | 16/60 |
| 8,443,487 | B2 * | 5/2013 | Bacchetti | 16/51 |
| 8,806,715 | B2 * | 8/2014 | Bienek et al. | 16/53 |
| 8,813,313 | B2 * | 8/2014 | Freitas Marinho et al. | 16/378 |

(Continued)

FOREIGN PATENT DOCUMENTS

| | | |
|---|---|---|
| DE | 103 36 075 A1 | 3/2005 |
| DE | 298 25 208 U1 | 3/2006 |
| EP | 0 244 506 A2 | 11/1987 |

*Primary Examiner* — Katherine Mitchell
*Assistant Examiner* — Catherine A Kelly
(74) *Attorney, Agent, or Firm* — Cantor Colburn LLP

(57) ABSTRACT

A door operator for opening and/or for closing a door includes a housing, an output shaft with a cam disc, and a first piston guided in the housing, which first piston bears against the cam disc. The output shaft includes a first axle body supported in the housing. The first axle body is connected to the cam disc in a torque-proof manner by a first plug-in connection.

6 Claims, 5 Drawing Sheets

(56) References Cited

U.S. PATENT DOCUMENTS

| | | | | |
|---|---|---|---|---|
| 2007/0256275 | A1* | 11/2007 | Winkler | 16/53 |
| 2008/0042330 | A1* | 2/2008 | Karkkainen et al. | 267/127 |
| 2008/0127452 | A1* | 6/2008 | Jackson | 16/50 |
| 2008/0222957 | A1* | 9/2008 | Bienek | 49/43 |
| 2011/0197391 | A1* | 8/2011 | Yu et al. | 16/51 |
| 2012/0117755 | A1* | 5/2012 | Walhorn | 16/66 |

* cited by examiner

DOOR ACTUATOR

CROSS-REFERENCE TO RELATED APPLICATIONS

This is a U.S. national stage of application No. PCT/EP2012/004721, filed on 14 Nov. 2012, which claims priority to the German Application No. 10 2011 055 977.9, filed 2 Dec. 2011, the content of both incorporated herein by reference.

BACKGROUND OF THE INVENTION

1. Field of the Invention

The present invention relates to a door operator, in particular a door closer for operating a door.

2. Related Art

Door operators are understood to be in particular door closers, servo-assisted door closers and door drives. In door closers, an energy accumulator is usually pre-loaded by manually actuating the door leaf. The door can be closed again without manual actuation, by discharging the energy accumulator. The door closers are either attached directly to the door leaf, to a door transom or to a wall. With an attachment to the door leaf, an arm assembly is attached to the output shaft of the door closer. It is via this arm assembly that the force is transferred onto the wall, respectively onto the transom. When mounting the door closer to the transom or to the wall, the force is transferred onto the door leaf via the arm assembly. As an alternative, it is likewise possible to connect the output shaft coaxially to the axis of rotation of the door. With known door operators with a cam drive, the installation of the cam with the output shaft is problematic in the limited constructional space between the opening piston and the damping piston, respectively the closing piston.

SUMMARY OF THE INVENTION

Therefore, it is an object of the present invention to provide a door operator which, while being manufactured in a cost-effective manner, is easy to install. Furthermore, it is an object of the present invention to indicate an installation method for the door operator.

The problem is, according to an aspect of the invention, thus solved by a door operator for opening and/or for closing a door, comprising a housing, an output shaft with a cam disc and a piston, guided in the housing and bearing against the cam disc. The output shaft comprises a first axle body supported in the housing. The axle body is connected to the cam disc to be torque-proof by a first plug-in connection. The cam disc and the first piston are configured in particular for transforming a rotational movement of the output shaft into a linear movement of the piston. In case the door operator is configured as a door closer, the force of a closer spring acts for example upon the first piston. As an alternative, for example for a door drive, the piston may be moved hydraulically and the output shaft can thus be entrained into rotation via the cam disc. According to an aspect of the invention, the installation of the door operator is facilitated in that the axle body and the cam disc have parts configured to be complementary to the first plug-in connection. Thus, initially the cam disc can be inserted and thereupon the axle body can be introduced.

In a preferred embodiment, the output shaft comprises a second axle body supported in the housing and connected to the cam disc in a torque-proof manner, wherein the first and the second axle bodies are disposed on opposite sides of the cam disc. By utilizing two axle bodies, the cam disc is supported on two opposite sides in the housing. At least one of the two axle bodies protrudes through the housing to the outside such that, for example, an arm assembly for the transmission of forces onto the door leaf or onto the transom can be mounted to this axle body. It is preferred that both axle bodies protrude to the outside such that, depending on the opening direction of the door, the arm assembly can be optionally installed to the first axle body or to the second axle body.

The second axle body may be securely attached to the cam shaft without a plug-in connection or may be even integrally manufactured with the cam disc. As an alternative to the above option, it is preferred that the second axle body is connected to the cam disc in a torque-proof manner by a second plug-in connection. The output shaft thus consists of three separate structural components, namely the cam disc, the first axle body and the second axle body.

The first and/or the second plug-in connection preferably represent a positive connection between the cam disc and the first, respectively the second axle body. In addition to the positive connection, the axle bodies may be non-positively and/or positively connected to the cam disc as well. For this purpose, in particular welding, preferably resistance welding, bonding or pressing the structural components together is intended.

In a preferred embodiment, it is intended that the first plug-in connection comprises a first extension at the first axle body and a recess in the cam disc complementary to the first extension. As an alternative, the first plug-in connection may comprise a first extension at the cam disc and a recess in the first axle body complementary to the first extension.

The configuration is preferably likewise provided for the second plug-in connection. Thus, the second plug-in connection may preferably comprise a second extension at the second axle body and a second recess in the cam disc complementary to the second extension. As an alternative, the second plug-in connection comprises a second extension at the cam disc and a second recess in the second axle body complementary to the second extension.

It should be understood by an extension complementary to the recess, that the extension can be introduced into the recess; and thus allows for a positive connection between the axle body and the cam disc in the direction of rotation of the output shaft.

It is furthermore preferred that each of the two plug-in connections comprises respectively several extensions and correspondingly several recesses. In this case, the extensions and the recesses could be disposed in both the axle bodies and in the cam disc.

It is moreover preferably intended that the first extension and/or the second extension is configured as a polygon or with an oval cross-section. When utilizing several extensions for a plug-in connection, the individual extensions may be configured as pins with a round cross-section. The recesses are correspondingly configured so that the extensions can be introduced and so that a positive connection is established.

Furthermore, it is preferably intended that the door operator comprises a second piston guided in the housing. The first piston and the second piston are disposed on opposite sides of the cam disc and the first piston is securely connected to the second piston. The two pistons are in particular connected by several, in particular two or four, webs.

In this case, it is particularly and preferably intended, if a cross-section of the cam disc, in particular the smallest cross-section of the cam disc measured vertically to the output shaft, is larger than a clear distance between two webs, likewise measured vertically to the output shaft.

In particular, if the cam disc needs to be installed between the first and the second pistons, it is of particular advantage, if the first axle body and/or the second axle body are only introduced into the cam disc after positioning the cam disc. The cam disc can thus be pushed laterally between the first and the second pistons, and the axle bodies are then introduced into the cam disc from the top and from the bottom.

It is furthermore preferred, if a damping piston is provided, which is guided in a cylindrically-shaped hollow space in the second piston, wherein the damping piston bears against the cam disc. The damping piston dampens in particular a closing movement of the door leaf.

The first and the second axle bodies are preferably embodied as identical structural components.

The side of the first axle body located on the outside and/or the side of the second axle body located on the outside preferably feature/s a polygon joint. The polygon joint serves for the installation of the arm assembly. It is via this arm assembly that the force of the door closer is transferred onto the door leaf respectively onto the transom. In particular the polygon joints are configured as a square. In this case, the first plug-in connection and/or the second plug-in connection are configured with such geometry that, upon inserting the first axle body and/or the second axle body, a defined position of the lateral edges of the polygon joint with regard to the position of the cam disc is accomplished. In particular when installing the axle bodies, the position of the polygon joints defined to be parallel or under a predetermined angle to the cam.

The axle bodies are preferably manufactured as cold-extrusion parts, turned parts, milled parts, forged parts or cast parts. The cam disc is preferably manufactured as a stamped part, laser-cut part, profiled part, cold-extrusion part, sintered part, cast part or as a milled part.

The following advantageous embodiments refer mainly to the configuration of the door operator as a door closer. However, the advantageous embodiments may be applied to other door operators as well, such as door drives for example. The door operator, in particular configured as a door closer, comprises the first piston (opening piston) guided in the housing, which, on a first side, bears against the cam disc, and an energy accumulator acting upon the first piston (opening piston) and serving for storing a closing energy for the door. Moreover, the door operator comprises the damping piston guided in the cylindrically-shaped hollow space of the second piston (cylinder element), which damping piston, on a second side, bears against the cam disc. The second piston (cylinder element) is securely connected to the first piston (opening piston). The guidance of the first piston (opening piston) in the housing means, in particular, that an exterior surface of the first piston (opening piston) bears against an interior surface of the housing such that the first piston (opening piston) is guided in the housing to be linearly movable. Likewise, in particular an exterior surface of the damping piston bears against an interior surface of the cylindrically-shaped hollow space such that the damping piston is guided in the second piston (cylinder element) to be linearly movable. The rigid connection between the second piston (cylinder element) and the first piston (opening piston) means, in particular, that the second piston (cylinder element) has no degree of freedom with regard to the first piston (opening piston).

The prior art door operators with a cam disc very often encountered the problem that the pistons minimally tilted within their guide. As a consequence, a higher expenditure of forces was required to move the piston. In particular during the opening action of the door and thus during movement of the first piston (opening piston) against the closer spring, this minimal tilting of the piston was negatively noticed in prior art applications. Here, in the disclosed embodiment, the first piston (opening piston) is supported by the additional second piston (cylinder element) at the damping piston. The minimum tilting of the first piston (opening piston) is thereby reduced and thus the efficiency of the door operator is improved.

In a preferred embodiment, the energy accumulator comprises at least one closer spring. The closer spring is in particular configured as a compression spring. In a preferred embodiment, one end of the closer spring directly abuts against the end of the first piston (opening piston), which end is facing away from the cam disc. The other end of the closer spring abuts against the housing, in particular against a cover of the housing at the frontal side.

Moreover, it is preferably intended that a compression spring is disposed between a side of the damping piston facing away from the cam disc and the housing. A first end of the compression spring abuts against the damping piston. The other end of the compression spring abuts in particular against another cover in the housing at the frontal side.

In a preferred embodiment, it is intended that the first piston (opening piston) comprises a first pressure roller bearing against the cam disc. The first pressure roller is supported in the first piston (opening piston) to be rotatably movable. Thus, the first pressure roller allows for a low-friction transmission of forces between the first piston (opening piston) and the cam disc.

Moreover, the damping piston comprises preferably a second pressure roller which bears against the cam disc. The second pressure roller is supported in the damping piston to be rotatably movable. The second pressure roller allows for a low-friction transmission of forces between the damping piston and the cam disc.

Instead of the first and/or the second pressure rollers, preferably likewise corresponding friction surfaces may be configured at the first piston (opening piston) and/or at the damping piston for the transmission of forces onto the cam disc.

In a preferred embodiment, an exterior surface of the second piston (cylinder element) is guided in the housing. In particular the exterior surface of the second piston (cylinder element) is cylindrically-shaped. Thus, the second piston (cylinder element) is supported to the inside with regard to the damping piston. To the outside, the second piston (cylinder element) is guided in the housing to be linearly movable and is thus likewise supported with regard to the housing. As the second piston (cylinder element) is securely connected to the first piston (opening piston), the double support of the second piston (cylinder element) stabilizes likewise the first piston (opening piston) and thus prevents tilting of the first piston (opening piston), improving the efficiency of the door closer.

Moreover, it is preferably intended that the output shaft with the cam disc is disposed between the first piston (opening piston) and the second piston (cylinder element). As the first piston (opening piston) is securely connected to the second piston (cylinder element) and the cam disc is located between the two structural components, support of the first piston (opening piston) is accomplished on both sides of the cam disc.

Furthermore, it is preferably intended that the second piston (cylinder element) and the first piston (opening piston) together are integrally manufactured. In this case, it is in particular intended that the first piston (opening piston) and the second piston (cylinder element) are connected to each other by several webs. In particular two or four webs are provided. The cam disc is located between the webs, respectively the output shaft extends therebetween. In the integral manufacturing process, in particular the first piston (opening piston), the second piston (cylinder element) and all webs together are manufactured from one piece. As an alternative, it likewise is preferably intended to separately manufacture the first piston (opening piston) and the second piston (cylinder element) and to connect them to each other via webs.

The external diameter of the second piston (cylinder element) particularly preferably corresponds to the external diameter of the first piston (opening piston). This is why the second piston (cylinder element) and the first piston (opening piston) can be guided in a cylindrically-shaped bore in the housing, which has a constant diameter.

Furthermore, a non-return valve is preferably located in the damping piston. The non-return valve comprises in particular a spring-loaded ball. Furthermore, the non-return valve allows in particular for discharging excess pressure from a side of the damping piston facing away from the cam disc towards the pressure-less space between the first piston (opening piston) and the damping piston.

Preferably, a further non-return valve is provided in the first piston (opening piston). This non-return valve as well preferably comprises a spring-loaded ball. The further non-return valve allows for a pressure release from the reception compartment of the closer spring towards the pressure-less space between the first piston (opening piston) and the damping piston.

On the side of the damping piston facing away from the cam disc, a hydraulic damping compartment is preferably configured in the housing.

Furthermore, the invention comprises an installation method for a door operator, comprising the following steps in the given order:

(i) Providing a structural piston sub-assembly, comprising a first piston and a second piston, wherein the first piston is securely connected to the second piston by at least two webs;

(ii) Inserting a cam disc between the first piston and the second piston on a first side of the two webs;

(iii) Introducing a first axle body from a second side of the two webs passing between the two webs;

(iv) Joining a first plug-in connection, wherein a first portion of the first plug-in connection is configured at the first axle body and a second portion of the first plug-in connection, complementary to the first portion, is configured at the cam disc.

The first portion of the plug-in connection is in particular the extension. The second portion of the plug-in connection is in particular the recess in the cam disc. The advantageous embodiments, described in conjunction with the inventive door operator, will correspondingly be preferably applied to the inventive installation method.

BRIEF DESCRIPTION OF THE DRAWINGS

The invention will now be described in more detail, reference being made to one embodiment, in which.

DETAILED DESCRIPTION OF THE PRESENTLY PREFERRED EMBODIMENTS

In the following, the door operator, configured as a door closer 1, will be explained in detail based on the FIGS. 1 to 8.

Figure 1:
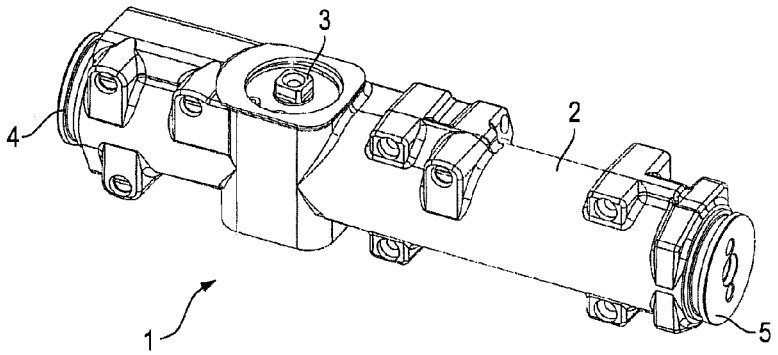
FIG. 1 shows an inventive door operator according to an exemplary embodiment.

FIG. 1 shows the door closer 1. The door closer 1 comprises an essentially cylindrically-shaped housing 2. The two frontal side ends of the housing 2 are closed off by a first cover 4 and a second cover 5. An output shaft 3 of the door closer 1 protrudes from the housing 2. An arm assembly, for example, attached to the output shaft 3. It is via this arm assembly that the force is transferred onto the door leaf, respectively onto the wall, or onto the door transom.

Figure 2:
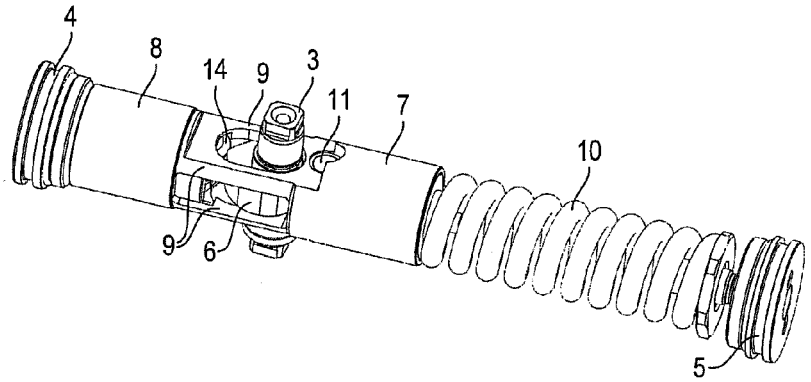
FIG. 2 shows the inventive door operator according to the exemplary embodiment without the housing.

In FIG. 2, the housing 2 of the door closer 1 is not shown. Furthermore, as can be seen in FIG. 2, the door closer 1 comprises a cam disc 6, which is connected to the output shaft 3 in a torque-proof manner. An opening piston 7 (first piston) is located on one side of the cam disc 6. The opening piston 7 is supported in the housing 2 to be linearly movable. For this purpose, the envelope surface of the opening piston 7 bears against the housing 2. A cylinder element 8 (second piston) is located on the other side of the cam disc 6. The cylinder element 8 is securely connected to opening piston 7 via four webs 9. In particular the opening piston 7, the cylinder element 8 and the webs 9 together are integrally manufactured.

Figure 3:
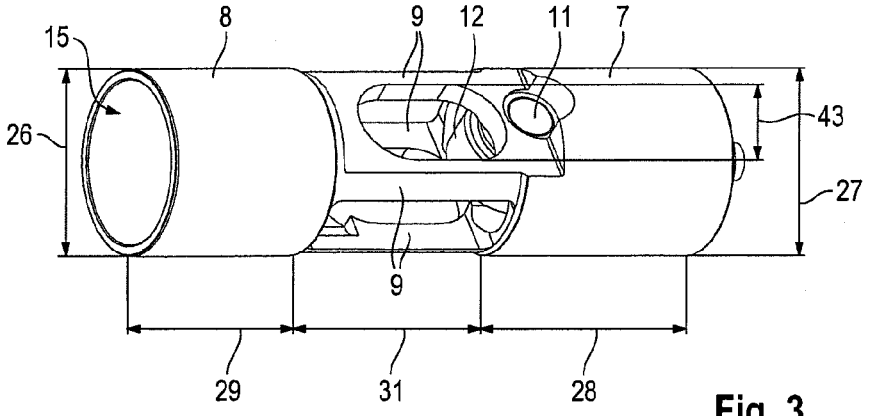
FIG. 3 shows an opening piston (first piston) with the cylinder element (second piston) of the inventive door operator according to the exemplary embodiment.

The opening piston 7 comprises a first pressure roller 12 (see FIG. 3). The first pressure roller 12 is supported in the opening piston 7 to be rotatably movable by a first pressure roller shaft 11. It is by said the first pressure roller 12 that the opening piston 7 bears against the cam disc 6. A damping piston 16 (see FIG. 4) is supported in the cylinder element 8 to be linearly movable. The damping piston 16 comprises the second pressure roller 14, which can be seen in FIG. 2. It is by the second pressure roller 14 that the damping piston 16 bears against the cam disc 6.

A closer spring 10 (energy accumulator) is located on the side of the opening piston 7 facing away from the cam disc 6. The closer spring 10 is configured as a compression spring and, with one end, abuts against the opening piston 7, and with the other end, abuts against the housing 2, in particular against the second cover 5.

The cam disc 6 is connected to the output shaft 3 in a torque-proof manner or is integrally manufactured with the output shaft 3. The cam disc 6 is configured to be heart-shaped. By opening the door leaf, the output shaft 3 is entrained into rotation. Thereby, the cam disc 6 rotates as well. In this case, in the position illustrated in FIG. 2, the cam disc 6 pushes the opening piston 7 to the right. The closer spring 10 is thereby compressed. During a closing action of the door, the closer spring 10 relaxes and pushes the opening piston 7 to the left. The cam disc 6 is thereby entrained into rotation. At the same time, the damping piston 16 with the second pressure roller 14 acts in a damping manner upon the rotational movement of the cam disc 6.

FIG. 3 shows the opening piston 7 and the cylinder element 8. According to FIG. 3, a cylindrically-shaped hollow space 15 is configured in the cylinder element 8. It is in this cylindrically-shaped hollow space 15 that the damping piston 16 (see FIG. 4) is guided to be linearly movable. Furthermore, also the exterior surface of the cylinder element 8 is configured to be cylindrically-shaped. The exterior surface of the cylinder element 8 bears against the housing 2. Thereby, the cylinder element 8 as well is guided to be linearly movable with regard to the housing 2.

Furthermore, FIG. 3 shows a first external diameter 26 of the cylinder element 8 and a second external diameter 27 of the opening piston 7. In a preferred embodiment, the first external diameter 26 is equal to the second external diameter 27 such that the cylinder element 8 and the opening piston 7 can be guided in a cylindrically-shaped bore in the housing 2 preferably having a constant diameter. Furthermore, the opening piston 7 has an opening piston length 28. The cylinder element 8 has a cylinder length 29. The opening piston 7 is guided in the housing 2 to be linearly movable over the entire opening piston length 28. The cylinder element 8 is guided in the housing 2 to be linearly movable over the entire cylinder length 29. The distance 31 is formed between the opening piston 7 and the cylinder element 8. The webs 9 extend over this distance 31 and the cam disc 6 is disposed within said distance 31. Preferably, the opening piston length 28 and the cylinder length 29 comprise at least 50% of the distance 31, in particular at least 75% of the distance 31.

Figure 4:
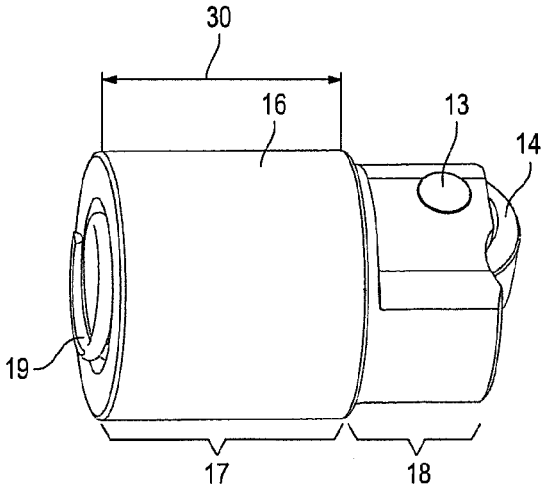
FIG. 4 shows a damping piston of the inventive door operator according to the exemplary embodiment.

FIG. 4 shows the damping piston 16. The damping piston 16 is subdivided into a guiding portion 17 and pressure roller portion 18. The guiding portion 17 features a damping piston length 30. Furthermore, the guiding portion 17 is configured with a cylindrically-shaped exterior surface. The damping piston 16 is guided in particular along the entire damping piston length 30 in the cylindrically-shaped hollow space 15 of the cylinder element 8 to be linearly movable. The pressure roller portion 18 is configured as an extension at the guiding portion 17. It is in this pressure roller portion 18 that the second pressure roller 14 is supported via a second pressure roller shaft 13 to be rotatably movable in the damping piston 16. Furthermore, the damping piston 16 features a hollow space. A compression spring 19 is located in this hollow space. Inside the damping piston 16, a first end of the compression spring 19 abuts against the damping piston 16. The other end of the compression spring 19 abuts against the housing 2, in particular against the first cover 4.

Figure 5:
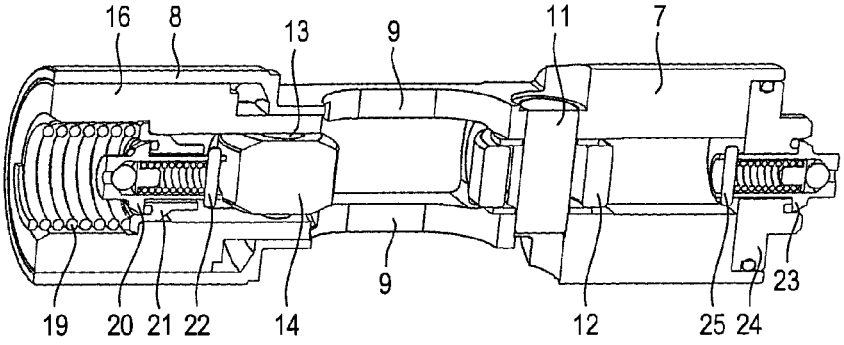
FIG. 5 shows a sectional view of the opening piston (first piston) and the damping piston of the inventive door operator according to the exemplary embodiment.

FIG. 5 shows a sectional view through the opening piston 7, the cylinder element 8 and the damping piston 16. In this illustration, the damping piston 16 is inserted into the cylinder element 8.

Furthermore, FIG. 5 shows a first non-return valve 20 in the damping piston 16. The first non-return valve 20 is attached to the damping piston 16 via a first bushing 21 and a first pin 22. The first non-return valve 20 allows for a pressure release from the side of the damping piston 16 facing away from the cam disc 6 towards the pressure-less compartment between the damping piston 16 and the opening piston 7.

A second non-return valve 23 is located in the opening piston 7. The second non-return valve 23 is installed in the opening piston 7 via a second bushing 24 and a second pin 25. The second non-return valve 23 allows for a pressure release from the side of the opening piston 7 facing away from the cam disc 6 towards the pressure-less compartment between the opening piston 7 and the damping piston 16.

By the secure and rigid connection between the opening piston 7 and the cylinder element 8, on the one hand, the opening piston 7 is supported with regard to the damping piston 16 and, on the other hand, the opening piston 7 is supported twice with regard to the housing 2, namely directly via the opening piston 7 and indirectly via the cylinder element 8. A potential tilting of the opening piston 7 is thereby avoided to a large extent and thus the efficiency of the door closer 1 is improved.

Figure 6:
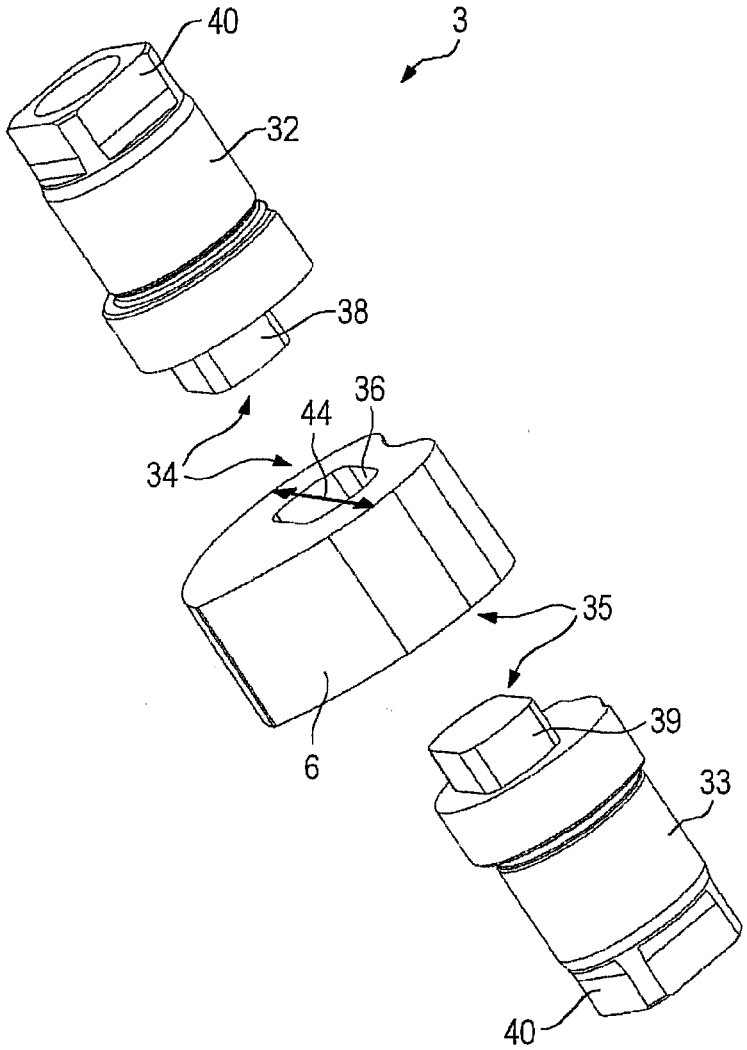
FIG. 6 shows a three-part output shaft with a cam disc of the inventive door operator according to the exemplary embodiment in an exploded illustration.
Figure 7:
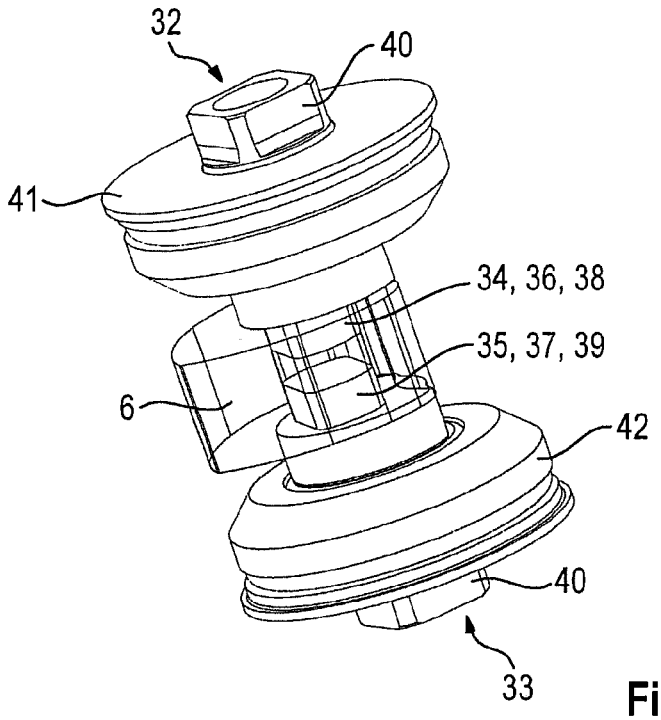
FIG. 7 shows the output shaft with a cam disc in an installed condition in a detailed view.
Figure 8:
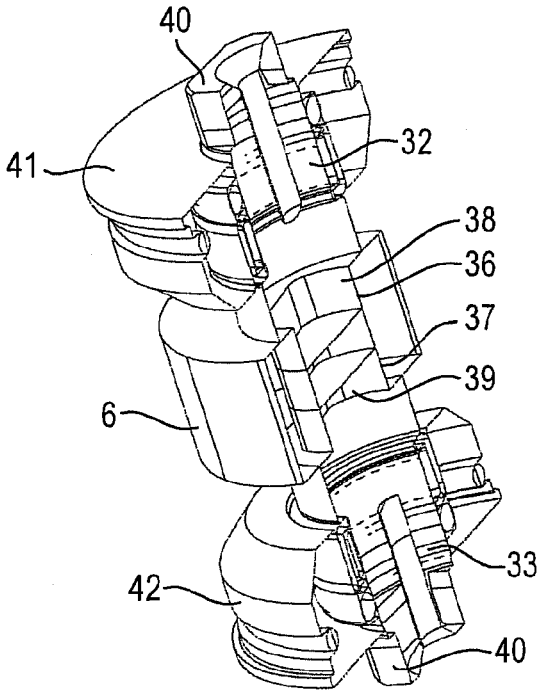
FIG. 8 shows a sectional view of the illustration of FIG. 7.

The FIGS. 6, 7 and 8 show in detail the output shaft 3 with the cam disc 6 of the door closer 1. In FIG. 6 the three-part output shaft 3 is shown in an exploded illustration. FIG. 7 shows the output shaft 3 in detail in the installed condition. FIG. 8 shows a section of the illustration of FIG. 7.

The output shaft 3 is composed of the cam disc 6, a first axle body 32 and a second axle body 33. At one end, the first axle body 32 comprises a first extension 38. A structural connection 40 is configured at the other end of the first axle body 32. An arm assembly is installed to the structural connection 40.

At one end, the second axle body 33 comprises a second extension 39. At the other end, the second axle body 33 comprises a further structural connection 40. As an alternative to the structural connection 40 at the first axle body 33, the further structural connection 40 may be likewise utilized for installing an arm assembly.

The two axle bodies 32, 33 are respectively integrally manufactured. Here, in the illustrated exemplary embodiment, the two axle bodies 32, 33 are configured as identical structural components.

The cam disc 6 comprises a first recess 36 and a second recess 37. The two recesses 26, 27 are configured on opposite sides of the cam disc 6. As can be seen in FIGS. 7 and 8, the first recess 36 is configured together with the second recess 37 as a through-hole in the cam disc 6.

The first extension 38 together with the first recess 36 forms a first plug-in connection 34. The second extension 39 together with the second recess 37 forms a second plug-in connection 35. For this purpose, the first extension 38 and the second extension 39 are respectively configured as squares with rounded corners. In a similar manner, likewise the first recess 36 and the second recess 37 are configured as internal squares with rounded corners. The configuration of the extensions 38, 39 as well as of the recesses 36, 37 may feature further shapes, such as a polygon or a multi-edge or another polygon shape, wherein the extensions 38, 39 need to be correspondingly matched to the recesses 36, 37.

As shown in FIGS. 7 and 8, the two axle bodies 32, 33 are introduced into the cam disc 6. In this case, a positive connection between the two axle bodies 32, 33 and the cam disc 6 is accomplished at both plug-in connections 34, 35 in the direction of rotation of the output shaft 3.

Furthermore, FIGS. 7 and 8 show a first axle cover 41 and a second axle cover 42. The first and the second axle covers 41, 42 are parts of the housing 2. Respectively one of the axle bodies 32, 33 is supported to be rotatably movable in the two axle covers 41, 42.

Furthermore, FIG. 8 shows that the length of the extensions 38, 39, respectively the thickness of the cam disc 6 is chosen such that the two extensions 38, 39 do not contact each other within the cam disc 6.

In FIG. 6 a smallest diameter 44 of the cam disc vertical with regard to the output shaft 3 is outlined. FIG. 3 shows a clear distance 43 between two webs, likewise measured vertically with regard to the output shaft 3. Here, in the illustrated exemplary embodiment, the first piston 7 (opening piston) is connected to the second piston 8 (cylinder element) via the four webs 9. The cam disc 6 is located between the four webs. Based on the fact that the diameter 44 of the cam disc 6 is larger than the clearance distance 43 between two webs 9, an output shaft integrally manufactured with the cam disc could not be installed in this case. The inventive advantage of a three-part output shaft is thus demonstrated.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A door operator (1) for operating a door, comprising:

a housing (2);

an output shaft (3) comprising, as separate components: a cam disc (6), a first axle body (32) supported in the housing (2) and a second axle body (33) supported in the housing (2), the first axle body (32) being non-rotatably connected to the cam disc (6) by a first plug-in connection (34) and the second axle body (33) being non-rotatably connected to the cam disc (6) by a second plug-in connection (35), the first and the second axle bodies (32, 33) being disposed on opposite sides of the cam disc (6);

a first piston (7) having a first piston length (28), guided in the housing (2) so as to be linearly movable with regard to the housing (2) over the first piston length (28) the first piston (7) bearing against the cam disc (6);

a cylinder element (8) having a cylinder length (29), the cylinder element (8) being guided in the housing (2) so as to bear against the housing (2) so as to be linearly movable with regard to the housing (2) over the cylinder length (29); and a damping piston (16) comprising a solid-walled cylinder surrounding a spring, the damping piston (16) being guided in a cylindrically-shaped hollow space (15) within the cylinder element (8), wherein the damping piston (16) bears against the cam disc (6), wherein the first piston (7) and the cylinder element (8) are disposed on opposite sides of the cam disc (6), and wherein the first piston (7) is rigidly connected to the cylinder element (8) by a plurality of webs (9) between the first piston 0 and the cylinder element (8).

2. The door operator according to claim 1, wherein:

the first plug-in connection (34) comprises a first extension (38) at the first axle body (32) and a first recess (36) in the cam disc (6), the first recess being complementary to the first extension (38), or the first plug-in connection (34) comprises a first extension (38) at the cam disc (6) and a first recess (36) in the first axle body (32) complementary to the first extension (38), and the second plug-in connection (35) comprises a second extension (9) at the second axle body (33) and a second recess (37) in the cam disc (6), which recess is complementary to the second extension (39), or the second plug-in connection (35) comprises a second extension (39) at the cam disc (6) and a second recess (37) in the second axle body (33) which recess is complementary to the second extension (39).

3. The door operator according to claim 1, wherein a smallest diameter (44) of the cam disc (6) is larger than a clearance distance (43) between two of the plurality of webs (9).

4. The door operator according to claim 1, wherein:

the first plug-in connection (34) comprises a first extension (38) at the first axle body (32) and a first recess (36) in the cam disc (6), the first recess being complementary to the first extension (38), or the first plug-in connection (34) comprises a first extension (38) at the cam disc (6) and a first recess (36) in the first axle body (32) complementary to the first extension (38).

5. The door operator according to claim 1, wherein:

the second plug-in connection (35) comprises a second extension (39) at the second axle body (33) and a second recess (37) in the cam disc (6), which recess is complementary to the second extension (39), or the second plug-in connection (35) comprises a second extension (39) at the cam disc (6) and a second recess (37) in the second axle body (33) which recess is complementary to the second extension (39).

6. An installation method for a door operator (1) comprising:

providing a housing;

forming an output shaft (3) comprising, as separate components: a cam disc (6), a first axle body (32) supported in the housing (2) and a second axle body (33) supported in the housing (2), the output shaft being formed by:

non-rotatably connecting the first axle body (32) to the cam disc (6) by a first plug-in connection (34), and non-rotatably connecting the second axle body (33) to the cam disc (6) by a second plug-in connection (35), the first and the second axle bodies (32, 33) being disposed on opposite side of the cam disc (6);

guiding a first piston (7), having a first piston length (28), in the housing so as to be linearly movable with regard to the housing (2) over the first piston length (28) such that the first piston (7) bears against the cam disc (6);

guiding a cylinder element (8) having a cylinder length (29), in the housing (2) so as to bear against the housing (2) so as to be linearly movable with regard to the housing (2) over the cylinder length (29); and guiding a damping piston (16), comprising a solid-walled cylinder surrounding a spring, in a cylindrically-shaped hollow space (15) within the cylinder element (8), wherein the damping piston (16) bears against the cam disc (6), wherein the first piston (7) and the cylinder element (8) are disposed on opposite sides of the cam disc (6), and wherein the first piston (7) is rigidly connected to the cylinder element (8) by a plurality of webs (9) between the first piston (7) and the cylinder element (8).

* * * * *